United States Patent [19]

Pawlowski et al.

[11] Patent Number: 4,935,276

[45] Date of Patent: Jun. 19, 1990

[54] ABSORBENT PAD AND METHOD OF MANUFACTURE

[75] Inventors: Thomas D. Pawlowski, Neenah; William G. Ticknor, Larsen, both of Wis.; Milo R. Johnston, Doylestown, Pa.

[73] Assignee: James River Corporation of Virginia, Richmond, Va.

[21] Appl. No.: 285,511

[22] Filed: Dec. 16, 1988

[51] Int. Cl.[5] ..... B65D 85/00; B32B 27/02

[52] U.S. Cl. ..... 428/35.7; 426/107; 426/124; 428/286; 428/287; 428/192; 428/233

[58] Field of Search ..... 426/124, 107; 428/35.7, 428/286, 287, 233, 142

[56] References Cited

U.S. PATENT DOCUMENTS

| | | | |
|---|---|---|---|
| 4,289,130 | 9/1981 | Usami et al. | 428/286 |
| 4,379,192 | 4/1983 | Wahlquist et al. | 428/286 |
| 4,390,554 | 6/1983 | Levinson | 426/124 |
| 4,552,789 | 11/1985 | Winchell | 426/124 |
| 4,560,608 | 12/1985 | Pusch et al. | 428/287 |
| 4,720,410 | 1/1988 | Lundquist et al. | 426/124 |
| 4,786,513 | 11/1988 | Monforton et al. | 426/124 |

*Primary Examiner*—James Seidleck

*Attorney, Agent, or Firm*—William A. Aguele; Richard J. Gallaher; Thomas H. Whaley

[57] ABSTRACT

An absorbent pad structure particularly suited for use in a vacuum package for a food product and the like is disclosed as well as its method of manufacture. The composition of the pad is such as to minimize leakage of liquids into the absorbent material during storage and to permit the flow of liquids freely for absorption during cooking of the packaged product. The pad is particularly suitable for use in bacon packages and other food packages containing oils or grease.

25 Claims, 2 Drawing Sheets

ABSORBENT PAD AND METHOD OF MANUFACTURE

This invention relates to an absorbent pad especially useful in packages for food products and the like and to packages comprising the absorbent pad structure. In one of its more specific embodiments, the absorbent pad forms a component part of a food package in which the food product is packed and stored until ready for use and then heated or cooked while in the package.

The use of microwave ovens for cooking, partially cooking, or reheating precooked foods has created a demand for a package for prepared foods which preserve the contents over an extended period of time while maintaining an attractive package appearance and in which the food may be heated or cooked.

It is an object of this invention to provide such packages and components thereof which will permit meats, such as cured bacon, to be vacuum packed and stored without objectionable discoloration of the package and will permit cooking of the meat in the package by microwave heating without excessive spattering of grease or meat juices. The desired object is accomplished primarily by incorporation into the package of a novel absorbent layer or pad which readily absorbs juices, oils and molten fat released from the food during the cooking period.

The novel absorbent pad comprises an absorbent fibrous mat of sufficient liquid absorption capacity to retain liquids released during cooking of the food, an imperforate liquid impermeable thermoplastic barrier film layer covering the upper surface of the absorbent fibrous mat, and a liquid impermeable backing layer joined to the opposite surface of said absorbent fibrous mat.

The absorbent pad structure, which is the essential element of the package, is particularly suited for use in packages for cured bacon and the like which release fairly large amounts of molten fat and residual briny liquid when cooked. The absorbent pad is useful also in packages containing breaded cuts of meat, fish, poultry, vegetables, or other foods containing fats or oils. The pad is especially suitable for use in vacuum packaging equipment.

Some packages currently available for packaging bacon, for example, contain pads or inserts which are capable of absorbing oils and other liquids released during the cooking period. While the pads perform the function of absorption of liquids when the product is heated or cooked in the package, they also absorb liquids and oils during storage resulting in staining which detracts from the appearance of the package, particularly with the transparent packaging films which are most in demand for packaging foods. Such absorbent inserts do not lend themselves to use with vacuum packaging equipment, most commonly used for packing bacon, which cause liquids to be expressed from moist and oily or greasy products resulting in staining of the absorbent pad. Water and oil tend to migrate laterally to the edges of the pad so that the stains are visible through the external package wrap even when the bottom of the absorbent pad is covered with waxed paperboard.

U.S. Pat. No. 4,720,410 to Lundquist et al. discloses a heat activated blotter designed for use in a meat package to protect the product during storage and to absorb liquids during cooking. The blotter structure comprises an absorbent pad of molded paper pulp covered by a heat shrinkable film partially attached to the absorbent means and one or more openings in the film to permit liquids from the food to reach the absorbent material. On heating, the film shrinks, enlarging the opening to permit better access of liquids from the meat product to the absorbent material. Openings in the film also tend to allow grease, oil and aqueous liquids from the meat product to access the absorbent material during storage resulting in staining of the absorbent layer of the blotter. Pressure resulting from vacuum packaging or stacking of the packages on one another increases the rate at which fluid is exuded from the product and absorbed by the absorbent.

The absorbent pads of the present invention overcome problems of liquid seepage into the absorbent pad from the packaged food product during storage while at the same time providing free access of the released liquids from the food product to the absorbent layer of the pad when the food product is cooked. The absorbent pad structure of this invention differs from those currently available in that the pad is covered with an imperforate, liquid impervious thermoplastic film which melts on heating. The absorbent layer preferably is made up of fibers which are capable of absorbing oils and liquids.

The absorbent pads and methods for their manufacture will be more readily understood from the following detailed description and accompanying drawings.

BRIEF DESCRIPTION OF DRAWING

With reference to FIG. 1 of the drawings, a bacon package designed for cooking cured bacon in a microwave oven is illustrated in somewhat exaggerated vertical scale wherein the numeral 10 represents an absorbent pad as described in more detail hereinafter encased in a plastic packaging film envelope 12 of conventional construction which may be transparent or partially transparent and partially opaque. Bacon slices 14 are laid on top of the absorbent pad and in this illustration are visible through the packaging film.

At the packaging plant, cured bacon from a slab is sliced onto the pad, sealed in the plastic film wrap, preferably by customary vacuum packaging equipment and packed into cartons for distribution to retail outlets. When purchased by the consumer and ready for cooking in a microwave oven, the top of the package is opened, e.g. by cutting or removal of sealing means, to permit steam to escape from the package as the bacon cooks and to facilitate removal of the cooked bacon. During the cooking period, fat rendered from the bacon is absorbed by the absorbent pad 10. When the bacon has been cooked to the desired extent, the package is opened, the bacon slices removed, and the package discarded.

Figure 2:
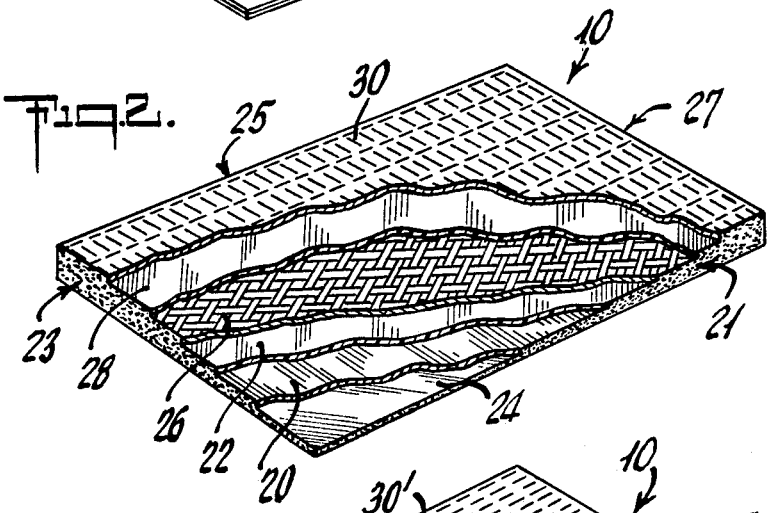
FIG. 2 is a perspective view of one preferred embodiment of the absorbent pad with successive layers partially cut away to show details of its construction.

With reference to FIG. 2, illustrating a preferred embodiment of an absorbent pad of this invention, the absorbent pad 10 is constructed with a relatively stiff backing layer 20, suitably of wax impregnated paperboard and preferably laminated or coated on both sides with polyethylene 22 and 24 by extrusion coating and lamination as described hereinafter. The backing layer may be of any material having enough stiffness to function on a conventional bacon slicing and packaging machine and which will not absorb significant amounts of moisture or grease during storage of the packaged product. The backing layer 20 also should be made of a material which is essentially non-wicking and does not show objectionable discoloration. It is essential that the backing layer be of such material that it will resist heat on cooking and maintain the package integrity after cooking. Suitable backing layer materials include wax impregnated paper and paperboard, grease resistant paper and paperboard, and films or sheets from various resins, for example, nylon, polyethylene terephthalate, polybutylene terephthalate, polypropylene, polyvinyl chloride, high density polyethylene, and some low or medium density polyethylene materials.

The absorber layer 26 can be made from any material which will absorb grease and liquids during and after cooking of the bacon or similar food products and will remain intact during packing, shipping, storage, marketing and cooking operations. The material must meet standards for use with such food products as set by government regulations, for example, those of the United States Department of Agriculture (USDA) and the United States Food and Drug Administration (FDA). Melt blown random structure homopolymer polypropylene fibers having a diameter in the range of 0.5 to 30 microns have been found particularly well suited for this use. A 10 to 800 g/m$^2$ basis weight absorber layer or mat of meltblown polypropylene fibers with a melting point of 325° F. and an apparent density in the range of 0.03 to 0.4 g/cm$^3$ produced by James River Corporation, Milford, N.J., under the trade name Polyweb meets all of the above mentioned requirements. The meltblown fibers forming the absorbent mat layer may be bonded or unbonded and the absorbent mat layer may or may not be embossed.

Other suitable absorber materials include non-woven cellulosic pads, resin bonded paper products, and open cell foams of heat resistant plastic materials, including polypropylene, polyethylene terephthalate, polypropylene terephthalate, polybutylene terephthalate, nylon, and some high, medium or low density polyethylenes. Bonding of the fibers by known methods, for example, by needle punching, thermal bonding, resin bonding, hydroentanglement or the like, provides fiber stability which improves lamination efficiency in the manufacture of the pads, and improves the appearance of the completed pad.

The design of the pad is determined by the needs of the food product packaged with the pad, the required thickness of the absorbent mat 26 depending on the amount of fluid released during the cooking cycle. An absorbent mat or layer of polypropylene fibers having a basis weight of 200 grams per square meter has been found adequate for bacon packaging, but the density may be greater or less depending on the amount of absorbent needed for the particular product.

In a preferred embodiment, the absorbent mat 26 is bonded to the base layer 20 by a bonding layer 22 formed by extrusion lamination of a low density polyethylene. Other thermoplastic materials suitable for this purpose include medium and high density polyethylenes; polypropylene; copolymers of ethylene/methacrylate, ethylene/vinylacetate, ethylene/acrylic acid, and ethylene/methacrylic acid; and various ionomers, e.g. those sold under the trade name Surlyn by E. I. duPont and described generically as metal salts of ethylene/methacrylic acid copolymers containing interchain ionic bonds.

Alternatively, but less desirably, the bonding layer 22 may be made up from a heat resistant, grease resistant, USDA/FDA approved adhesive, a number of which are commercially available.

An imperforate, fluid impervious film barrier layer 28 covers the entire top surface of absorber mat layer 26 and is bonded to the top surface of the absorber mat layer, preferably by extrusion lamination as described hereinafter. The barrier layer 28 functions as a bonding agent between the absorber layer 26 and the food contact surface layer, i.e. the cooking surface layer 30, and as an impervious barrier to grease and liquids during storage and distribution of the packaged product. The barrier layer must be imperforate to prevent staining of the absorber layer prior to the heating or cooking operation. During the cooking period, as by microwave, the barrier layer 28 melts and opens spontaneously to permit passage of liquids from the cooking surface layer 30 to the absorber layer 26.

A preferred polymer for use as the barrier layer 28 is a low density polyethylene resin having a melt index of about 6 and a density of about 0.9 suitable for extrusion coating of paper, film and other base stocks. A film thickness of about 7 to 12 pounds per 3000 square feet (13 g/m$^2$) of this material has been found suitable as the barrier layer 28.

In specific examples of preferred embodiments of this invention, the low density polyethylene forming laminations and coatings 24, 22, and 28 have the following properties: a density of from about 0.915 to 0.930 g/cc and a melt index of from about 4 to about 13 g/10 min.

A number of other polymeric thermoplastic resins suitable for use as the barrier layer are available, including very low, medium and high density polyethylenes; polypropylene; Surlyn; and copolymers of ethylene/vinyl acetate, ethylene/acrylic acid, and ethylene/methacrylic acid. It will be understood that the film thickness required for the barrier layer is dependent upon the properties of the particular thermoplastic resin from which the barrier film layer 28 is formed and is best determined by trial for each resin. The melting point of the polymer resin from which the barrier film 28 is formed will usually influence the thickness required to permit the film to melt as the food product is cooked. The layer 28 must be pinhole free to prevent the absorber layer 26 from absorbing fluids during storage and distribution of the packaged product.

The food contact surface layer 30 may be bonded to the absorber layer 26 by the barrier layer 28, by any of several methods, for example, by thermal lamination, adhesive lamination or preferably by extrusion lamination. In a preferred embodiment, illustrated in FIG. 2, the surface layer 30 of pad 10 is an embossed melt blown polybutylene terephthalate non-woven web. A 435° F. m.p. polybutylene terephthalate, bonded or not, melt blown non-woven web having a basis weight of 10 to 100 grams per square meter, a fiber diameter in the range of 0.5 to 30 microns; an apparent density of about 0.14 g/cc; a tensile strength in the machine direction of about 3 pounds per lineal inch and in the cross machine direction of about 1.9 lbs/in has been found very satisfactory as a preferred surface layer 30. Such products are produced by James River Corporation and marketed under the trade name Polyweb. Bonding, as mentioned hereinabove, locks the fibers in place and stabilizes the surface of the pad.

A number of other commercially available resins and fibers are suitable for use in making the cooking surface layer 30. Suitable materials include those produced from polymethylpentenes, polyethylane terephthalates, polybutylene terephthalates, polypropylenes, and high density polyethylenes, and other materials which meet FDA requirements at the cooking temperatures. The edges 21, 23, 25, and 27 of layers 20, 22, 26 and 28 are preferably sealed by a suitable sealant, e.g. polyethylene, or even more preferably by thermal bonding of the edges of the layers.

The cooking surface layer 30 must be of a material which offers good food release (absence of sticking to the food product), good heat resistance, grease and liquid permeability during cooking, and resistance to grease absorption under vacuum during storage. The cooking surface also must retain its shape during cooking of the food product.

Figure 3:
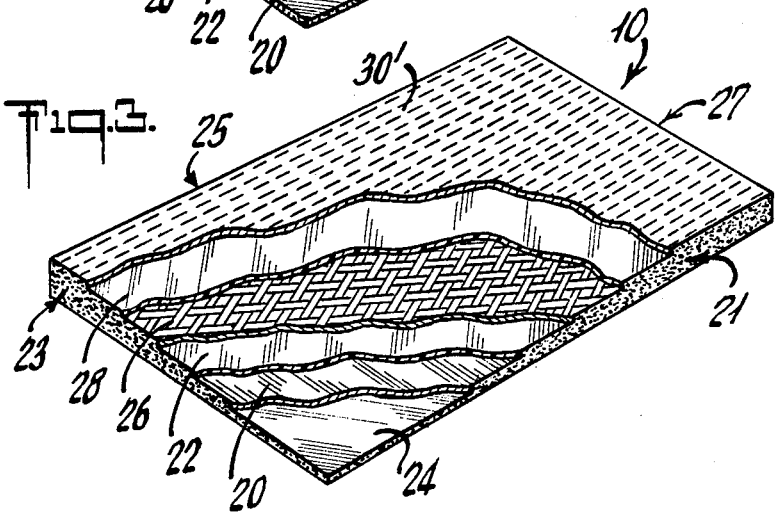
FIG. 3 is a perspective view similar to FIG. 2 of another preferred embodiment of the absorbent pad.

Another preferred cooking surface layer is illustrated in FIG. 3 wherein the surface layer designated by the numeral 30' is a silicone treated parchment paper. In this specific embodiment, openings, e.g. knife slits 32, or perforations (not illustrated) are provided to permit liquids to pass through from the food product to the absorber pad 26 as the heat of cooking causes the barrier film 28 to melt and become liquid permeable during the cooking period. A 20 to 30 pound per 3000 sq. ft. ream parchment paper coated on one side with food grade silicone, e.g. silicone 701, as marketed by James River Corporation, KVP Products Div., Parchment, Mich. under the trade designation 01465, perforated or slit to permit drainage of liquids uniformly through the paper, meets the requirements for a satisfactory cooking surface layer 30'.

Figure 4:
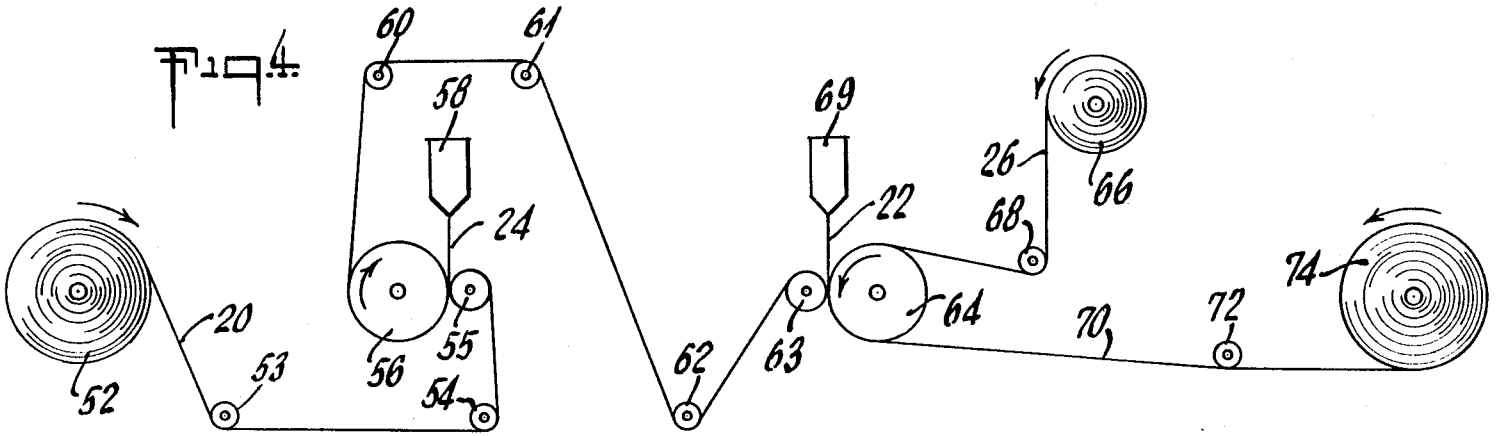
FIGS. 4 and 5 are diagrammatic elevational views illustrating an arrangement of apparatus for manufacture of laminates from which the absorbent pads of the desired size and shape may be cut.
Figure 5:
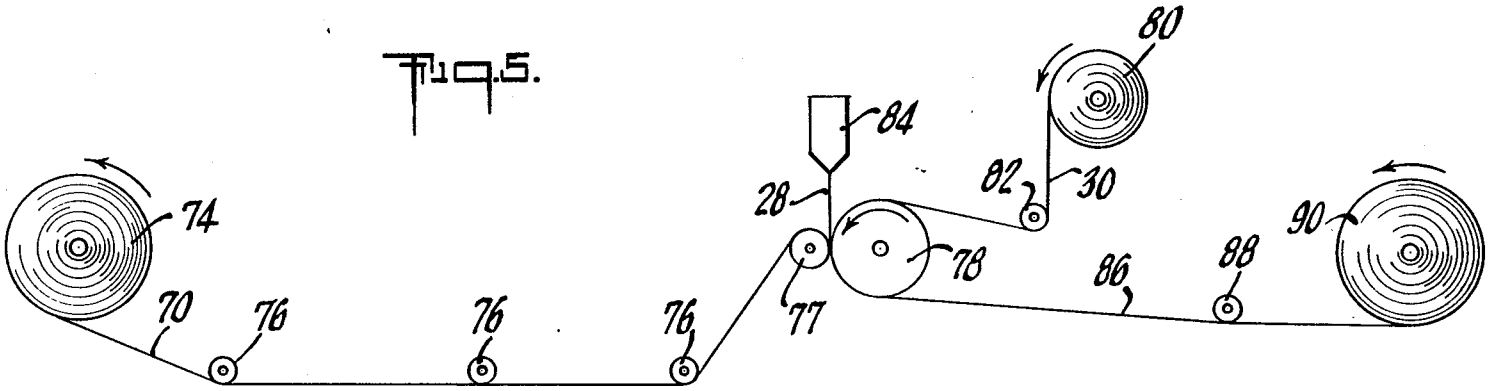

A preferred method of manufacture of the absorbent pads of this invention is illustrated diagrammatically in FIGS. 4 and 5 as a preferred specific example. With reference to FIG. 4, solid bleached sulfate paperboard 20 impregnated with food grade paraffin wax, m.p. about 140° F., and having a basis weight of 125 lb/3000 sq. ft. ream (203 g/m$^2$) is drawn from a roll 52 over idler rolls 53 and 54 to the nip formed by extruder rolls 55 and 56 where it is coated on one side with molten low density polyethylene 24 from extruder 58. The coating weight of the polyethylene is about 7 to 12 lbs/ream. The coated paperboard is drawn over idler rolls 60, 61, 62 into the nip formed by extruder rolls 63 and 64. Melt blown polypropylene non-woven fabric 26 having a basis weight of 10 to 800 grams/m$^2$ is drawn from roll 66 over idler roll 68 into the nip of rolls 63 and 64 where it is laminated to the uncoated side of paperboard 20 by a continuous film of molten low density polyethylene 22 applied by extruder 69 at the rate of about 7 to 12 lbs/ream. The resulting laminate 70 comprising the base 20 coated on one side with film 24 and laminated to layer 26 by film 22 is drawn over idler roll 72 and wound into a roll 74.

For convenience in illustrating the method of manufacture of the absorbent pads of this invention, the process is illustrated as a two-stage process with the first stage illustrated in FIG. 4 and the second, in FIG. 5. As illustrated, a roll 74 of laminate 70 as produced in the process steps illustrated in FIG. 4 becomes the source of supply of laminate 70 in the steps illustrated in FIG. 5. It will be apparent to those skilled in the art that the process may be carried out in a continuous single stage operation by passing laminate 70 directly to the next step in the sequence.

With reference to FIG. 5, the laminate 70, comprising an absorbent layer of polypropylene fibers 26 laminated to a backing material 20, is drawn from roll 74 over idler rolls 76 into the nip formed by rolls 77 and 78. Thermally bonded embossed melt blown polybutylene terephthalate non-woven fabric 30 having a basis weight of 15 to 100 g/m$^2$ is drawn from roll 80 over idler roller 82 and roll 78 into the nip formed by rolls 77 and 78 where it is laminated to the upper surface of the absorbent layer 26 by a continuous film of molten polyethylene 28 from extruder 84 applied at a rate of about 7 to 12 lbs/ream. The extruded polyethylene film 28 serves both as a thermoplastic barrier layer between webs 26 and 30 and as the adhesive bond between the webs.

A preferred method of manufacture has been described as one specific example with reference to FIGS. 2, 4 and 5. As previously mentioned, other materials than those specified in this example are suitable for the production of an absorbent pad of this invention. With particular reference to FIGS. 3 and 5, the web 30 may be replaced with silicone coated, perforated or slit parchment paper 30' parchment coated on its top surface (as in FIG. 3) with silicone. In another embodiment, not illustrated, the base layer 20 may be of a polymeric resin material. In still another embodiment, film layer 22 may be replaced by an adhesive, for example, by water based acrylate resin adhesives.

Figure 1:
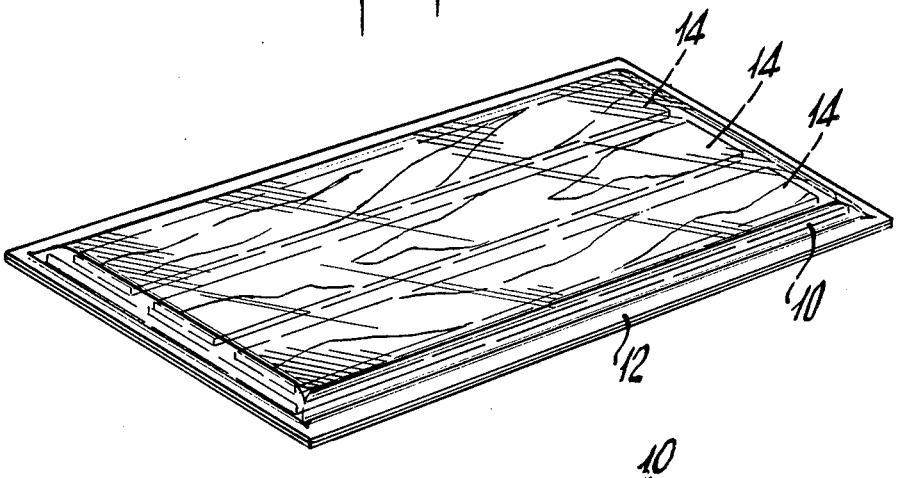
FIG. 1 of the drawings is a perspective view of a package for sliced cured bacon incorporating an absorbent pad of this invention.

The completed laminate 86 exits from rolls 77 and 78 over idler roller 88 and is wound into a roll 90. The laminate 86 may be cut into pads 10 of suitable size and shape by means not illustrated in the drawings to form the absorber pads illustrated in FIGS. 1 to 3.

What is claimed is:

1. A heat activated absorbent pad capable of absorbing oils, grease and oily liquids released from a food product during cooking which comprises (a) an absorbent fibrous mat of sufficient liquid absorption capacity to retain liquids released during cooking of the food, (b) an imperforate liquid impermeable thermoplastic barrier film layer covering the surface of the absorbent fibrous mat adjacent the food product during cooking, (c) a liquid impermeable backing layer joined to the opposite surface of said absorbent fibrous mat, and (d) a liquid permeable substantially non-sticking and non-absorbent heat stable cooking surface layer covering the surface of the barrier film layer.

2. An absorbent pad as defined in claim 1 wherein said absorbent fibrous mat is composed of polymer resin fibers.

3. An absorbent pad as defined in claim 2 wherein the mat is composed of polyolefin fibers.

4. An absorbent pad as defined in claim 1 wherein said backing layer is stiffer than the absorbent mat and is bonded thereto by a thermoplastic polymer resin.

5. An absorbent pad as defined in claim 4 wherein the thermoplastic polymer is a polyolefin.

6. An absorbent pad as defined in claim 4 wherein the backing layer is wax impregnated paper or paperboard.

7. An absorbent pad as defined in claim 4 wherein said backing layer is paper or paperboard coated on both sides and simultaneously laminated to said fibrous mat with a polyolefin.

8. An absorbent pad as defined in claim 1 wherein the liquid permeable cooking surface layer is a polymer resin having a higher melting point than the melting point of said barrier film.

9. An absorbent pad as defined in claim 8 wherein the surface layer is composed of polybutylene terephthalate fibers.

10. An absorbent pad as defined in claim 8 wherein the surface layer is composed of polyethylene terephthalate fibers.

11. An absorbent pad as defined in claim 8 wherein the surface layer is composed of nylon fibers.

12. An absorbent pad as defined in claim 8 wherein the surface layer is bonded to the absorbent fibrous mat by said thermoplastic barrier film.

13. An absorbent pad as defined in claim 1 wherein the edges of the pad are sealed against leakage of liquid.

14. An absorbent pad as defined in claim 1 wherein the barrier film layer is a thermoplastic polymer resin selected from the group consisting of polyolefins, and copolymers of ethylene/vinyl acetate, ethylene/acrylic acid, and ethylene/methacrylic acid.

15. An absorbent pad as defined in claim 1 wherein the liquid permeable cooking surface layer is parchment paper having a top surface coated with silicone and provided with perforations to permit liquids to pass through the surface layer to the underlying barrier film.

16. A heat activated absorbent pad as defined in claim 1 wherein the absorbent fibrous mat consists of polymeric fibers having a higher melting point than the melting point of the barrier film.

17. A package for food products which permits heating or cooking of foods containing fats and oils within the package by microwave radiation which comprises an absorbent pad as defined in claim 1 on which the foods are placed for packaging and an outer envelope type cover of a thermoplastic polymeric resin which is thermally stable at the temperatures generated by microwave radiation when the foods are heated or cooked in the package.

18. A method of manufacture of a heat activated absorber structure for the absorption of liquids released from food during microwave cooking thereof which comprises providing a relatively stiff paperboard base sheet, coating one side of said base sheet with a continuous film of thermoplastic resin laminating a non-woven liquid absorbent thermoplastic fibrous mat to the opposite surface of said base sheet by extrusion bonding with a continuous film of molten thermoplastic resin, providing a substantially non-absorbent fluid permeable and heat resistant fibrous web suitable as support for food during cooking thereof, and laminating said non-absorbent fluid permeable fibrous web support to said absorbent fibrous mat by extrusion bonding with a continuous film of thermoplastic resin forming an imperforate liquid impermeable film barrier between said fibrous web and said fibrous mat of a thermoplastic resin, said barrier film having a lower melting point than that of said fibrous web and of said fibrous mat.

19. A method according to claim 18 wherein said fibrous web is a melt blown random structure polymer web and said impermeable film barrier is polyethylene.

20. A method according to claim 19 wherein said impermeable film barrier is polyethylene.

21. A method according to claim 19 wherein said impermeable film barrier is polypropylene.

22. A method according to claim 18 wherein said stiffener is paper or paperboard.

23. A method according to claim 22 wherein said stiffener is wax impregnated paperboard.

24. A method according to claim 18 wherein said stiffener is bonded to said absorbent fibrous web by extrusion lamination with polypropylene.

25. A method according to claim 18 wherein said stiffener is bonded to said absorbent fibrous web by extrusion lamination with polyethylene.

* * * * *